US005450983A

United States Patent [19]

Stern et al.

[11] Patent Number: 5,450,983

[45] Date of Patent: Sep. 19, 1995

[54] AEROSOL SPRAY TEXTURE APPARATUS AND METHOD FOR A PARTICULATE CONTAINING MATERIAL

[75] Inventors: Donald J. Stern, Bellingham; James A. Tryon, Seattle, both of Wash.

[73] Assignee: DJS&T, Limited Partnership, Bellingham, Wash.

[21] Appl. No.: 216,155

[22] Filed: Mar. 22, 1994

Related U.S. Application Data

[63] Continuation-in-part of Ser. No. 30,673, Mar. 12, 1993, abandoned.

[51] Int. Cl.[6] ..... B65D 83/00

[52] U.S. Cl. ..... 222/1; 222/394; 222/402.1; 222/402.25

[58] Field of Search ..... 222/402.24, 402.25, 222/402.1, 402.21, 402.22, 402.23, 394, 365; 239/597, 592, 337, 340, 1

[56] References Cited

U.S. PATENT DOCUMENTS

| | | | |
|---|---|---|---|
| 2,353,318 | 7/1944 | Scheller | 239/592 |
| 2,686,652 | 8/1954 | Carlson et al. | 222/402.21 |
| 2,763,406 | 9/1956 | Countryman | 222/402.21 |
| 2,831,618 | 4/1958 | Soffer et al. | 222/394 |
| 2,932,434 | 4/1960 | Abdanalp | 222/402.24 |
| 3,198,394 | 8/1965 | Lefer | 222/402.21 |
| 3,544,258 | 8/1965 | Presant et al. | 222/192 |
| 4,036,673 | 7/1977 | Murphy et al. | 222/394 X |
| 5,037,011 | 1/1991 | Woods | 222/394 |
| 5,188,263 | 2/1993 | Woods | 222/394 |
| 5,341,970 | 8/1994 | Woods | 222/394 |

*Primary Examiner*—Andres Kashnikow
*Assistant Examiner*—Lisa Douglas
*Attorney, Agent, or Firm*—Robert B. Hughes; Hughes, Multer & Schacht

[57] ABSTRACT

An aerosol spray texture apparatus to dispense a spray texture material having particulate matter therein against a ceiling or other surface. There is a container having a spray texture material in the lower portion thereof, and inert compressed gas in the upper part of the container. A dispensing valve at the top of the container is depressed to cause the spray texture material to travel upwardly through a dispensing tube and from the valve onto the ceiling surface.

20 Claims, 6 Drawing Sheets

AEROSOL SPRAY TEXTURE APPARATUS AND METHOD FOR A PARTICULATE CONTAINING MATERIAL

CROSS REFERENCE TO RELATED APPLICATION

This is a continuation in part of U.S. patent application Ser. No. 08/030,673, filed Mar. 12, 1993 (now abandoned).

BACKGROUND OF THE INVENTION

1. Field of the Invention

The present invention relates to a texture spraying apparatus to discharge a texture material onto a surface, and more particularly to an aerosol spray texture apparatus particularly adapted for discharging a texture material having particulate matter contained therein.

2. Background Art

There are in the prior art various devices to spray a texture material onto a wall surface or a ceiling. Depending upon the nature of the composition and other factors, the material that is sprayed onto the surface as a coating can have varying degrees of "roughness".

In some instances, the somewhat roughened texture is achieved by utilizing a textured composition that forms into droplets when it is dispensed, with the material then hardening with these droplets providing the textured surface. In other instances, solid particulate material is mixed with the liquid texture material so that with the particulate material being deposited with the hardenable liquid material on the wall surface, these particles provide the textured surface.

There are in the prior art spray texture devices using an aerosol container which contains the texture material under pressure and from which the textured material is discharged onto a surface. Such aerosol dispensers are commonly used when there is a relatively small surface area to be covered with the spray texture material. Two such spray texture devices are disclosed in U.S. Pat. No. 5,037,011, issued Aug. 6, 1991, and more recently U.S. Pat. No. 5,188,263, issued Feb. 23, 1993 with John R. Woods being named inventor of both of these patents.

However, such prior art aerosol spray texture devices have not been properly adapted to deliver a texture having particulate matter therein to provide the rougher texture.

SUMMARY OF THE INVENTION

The present invention comprises an aerosol dispensing apparatus particularly adapted to dispense a spray texture coating material against a surface, where the material comprises a mixture of a carrier fluid component and a particulate material distributed throughout the fluid component.

This apparatus comprises an aerosol container having a main containing chamber adapted to contain said material in one part of said chamber and a propellant at a predetermined pressure level greater than ambient pressure in another part of said chamber. There is a valve assembly mounted to the container. This valve assembly comprises a valve housing means mounted to the container, and a valve element moveably mounted to the valve housing for movement between a closed and an open position. The valve assembly defines a discharge passageway means having an intake opening means communicating with the material containing part of said main chamber to receive the material therefrom, and an exit opening to discharge the material from the chamber.

The propellant either remains in a gaseous state, or remains in mostly a liquid state at the predetermined pressure level in the container, so that it can vaporize and expand to discharge the texture material. The particulate material comprises a plurality of particles having a predetermined maximum particle size, and having compressibility from the maximum particle size.

The intake opening means of the valve is sized and arranged relative to the maximum particle size and compressibility of the particles, so that with the valve element in the open position, when the particles are at the intake opening means and exposed to pressure in the container and to a lower pressure in the discharge passageway, and with the valve assembly in the open position, the particles in the mixture are able to pass through the intake opening means and out the discharge opening means.

In the preferred form, the valve assembly comprises entry chamber means defining an entry chamber having an intake opening connecting to the main chamber of the container, and also opening to the valve passageway in the valve assembly.

The valve passageway leads to an expanded passageway region, which in turn leads to a valve outlet of a smaller cross sectional area. The outlet nozzle desirably has an elongate, laterally extending nozzle opening.

In the embodiment where compressed gas is used as the propellant, the gas is in direct contact with the material. In a second embodiment where a vorizable liquid is used as the propellant, the material is contained in a flexible bag-like container to be separated from the propellant.

DESCRIPTION OF THE PREFERRED EMBODIMENT

Figure 1:
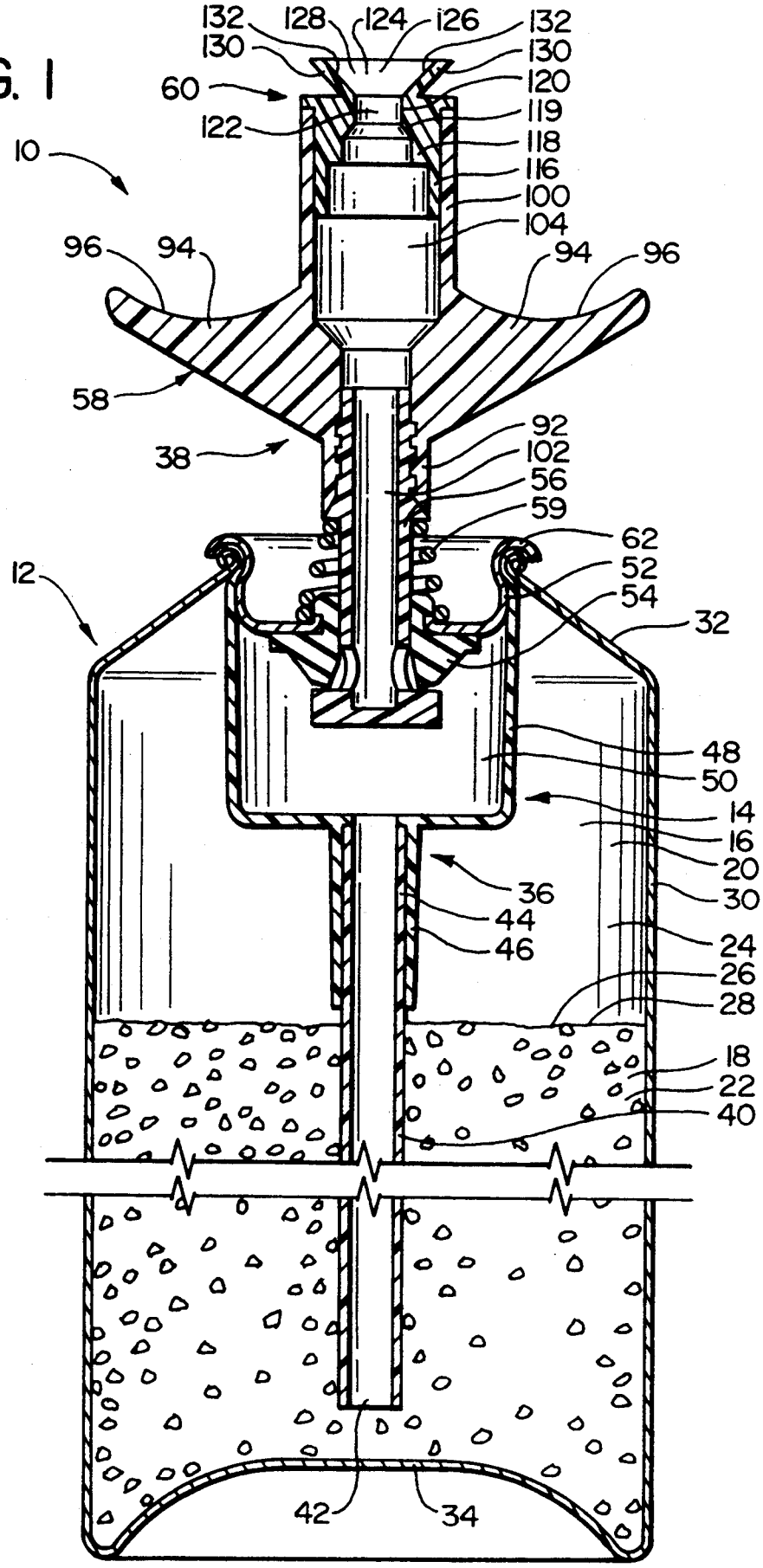
FIG. 1 is a longitudinal sectional view of a first embodiment of the present invention.
Figure 2:
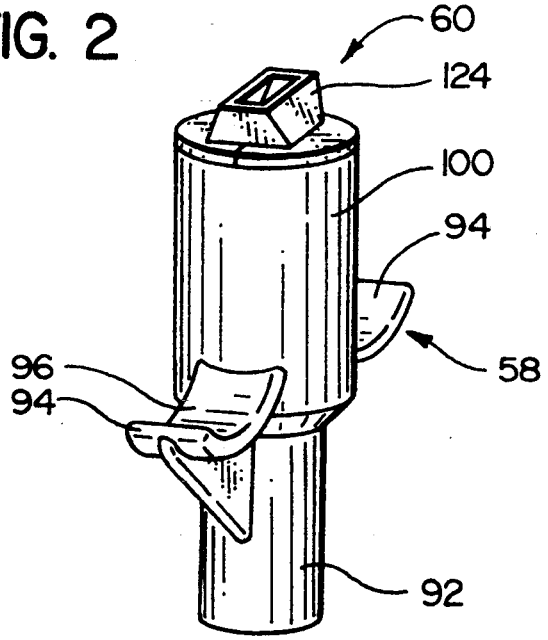
FIG. 2 is an isometric view of an upper portion of the valve assembly of the first embodiment.

FIG. 1 illustrates the apparatus 10 of the first embodiment of the present invention which is particularly adapted to apply an acoustic texture material to the surface of a ceiling. This apparatus 10 comprises a container 12 and a discharge assembly 14. The container 12 defines a chamber 16 having a texture material containing portion 18 and a propellant containing portion 20. In this first embodiment, the texture material containing portion 18 is located in the bottom part of the chamber 16 since the apparatus 10 is normally operated in a vertically aligned position so that the texture material 22 is positioned by gravity in the lower part of the chamber 16. The propellant containing portion 20 is in the upper part of the chamber 16, and the propellant 24 is a gaseous substance which is substantially inert, such as nitrogen or atmospheric air, relative to the texture material 22. There is a pressure interface 26 between the upper surface 28 of the texture material 22 and the gaseous propellant 24 that is immediately above, with the propellant 24 being (in this first embodiment) in direct contact with the texture material 22.

The container 12 comprises a cylindrical side wall 30, having an upper frusto-conical wall section 32, and a bottom wall 34. The discharge assembly 14 comprises an infeed section 36 and a valve section 38.

The infeed section 36 comprises a feed tube 40 having a lower open end 42 positioned adjacent to and just above the bottom wall 34, and an upper end 44 which fits within a downwardly extending stub 46 that is part of an entry chamber housing 48 that defines an entry chamber 50. To describe briefly the function of this infeed section 36, in operation the texture material 22 is forced by pressure from the propellant 24 to flow into the lower open end 42 of the tube 40 and into the entry chamber 50. From this chamber 50, the texture material flows into the valve section 38.

The valve section 38 comprises a mounting collar 52 (sometimes referred to as a "cup"), a flexible valve seal and mounting member 54, a valve stem 56, a valve handle portion 58, a positioning spring 59, and an end nozzle section 60.

Figure 4:
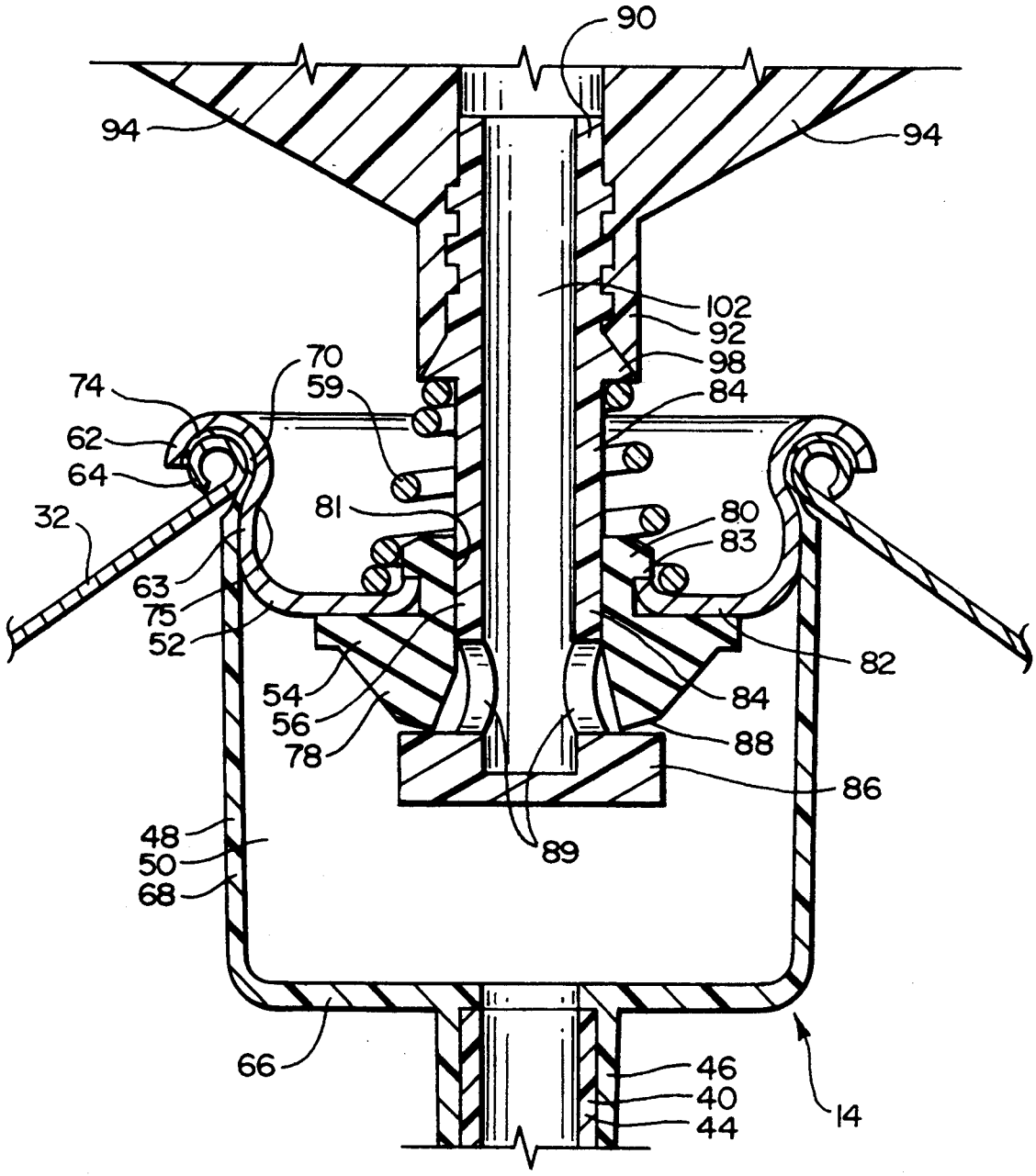
FIG. 4 is a longitudinal sectional view of the lower and middle portion of the valve assembly of the first embodiment of FIG. 1, with the valve in the closed position.
Figure 5:
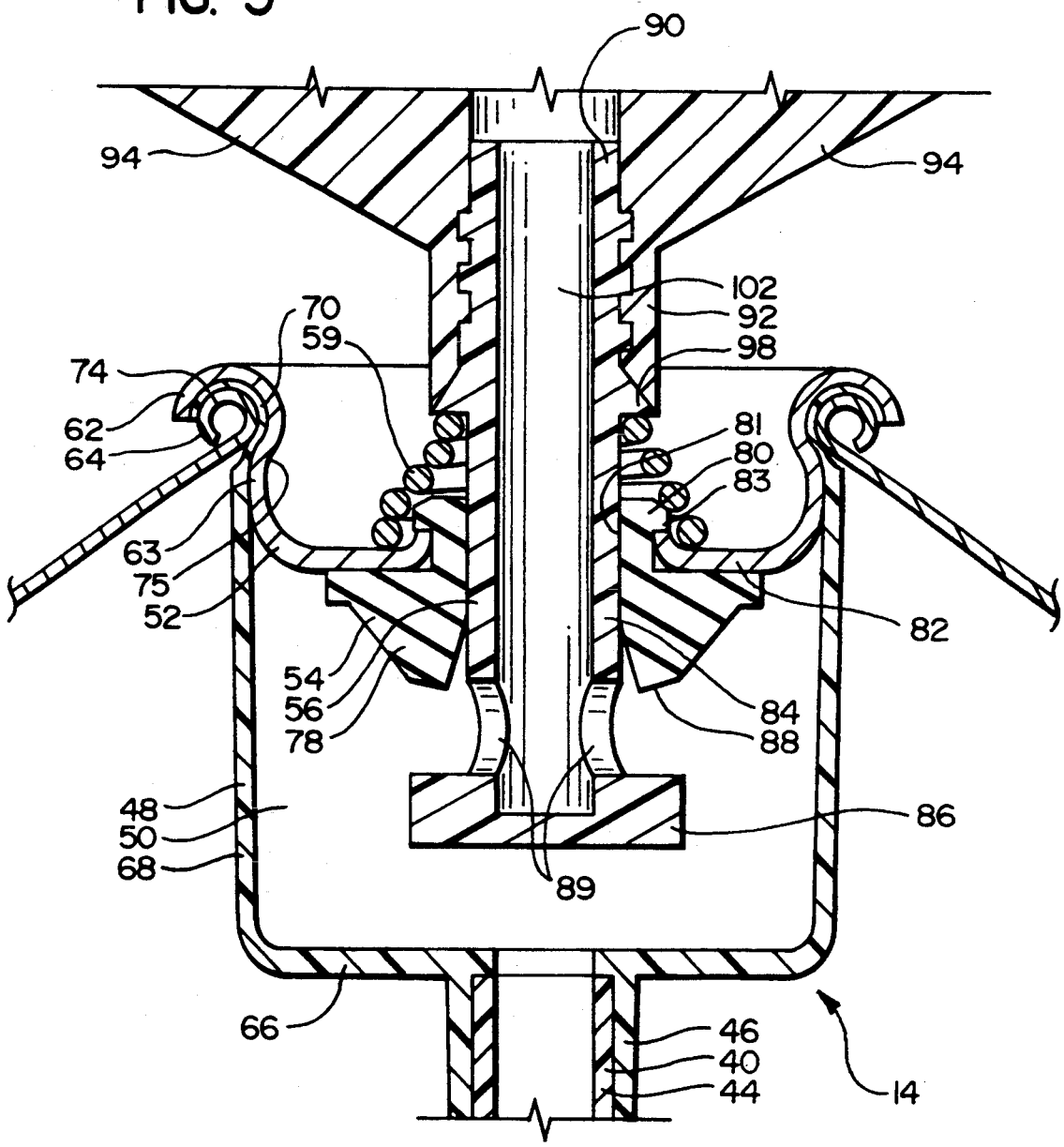
FIG. 5 is a view similar to FIG. 4, but showing the valve in the open position.

With reference to FIGS. 4 and 5, the valve mounting collar 52 has a perimeter portion 62 which extends upwardly from the collar side wall 63 to curve upwardly and outwardly and then downwardly in approximately a 180° curve. This perimeter portion 62 is positioned over a circumferential lip 64 that is formed from an inner circumferential edge of the upper wall 32 and extends in a circle around the inside edge of the frusto-conical upper wall 32. This lip 64 at its inner edge is curved (as seen in cross section) upwardly, outwardly and then downwardly in a curved configuration so as to fit within the curved perimeter portion 62 of the mounting collar 52.

A significant feature of the present invention is the manner in which this mounting collar 52 forms a seal with the upper container wall 32 and also forms a seal with the aforementioned entry chamber housing 48. More particularly, the entry chamber housing 48 comprises a bottom wall 66 and a cylindrical side wall 68. The walls 66 and 68 are made integrally of a semi-rigid plastic material which is able to yield moderately.

As can be seen in FIG. 4, the upper edge 70 of the side wall 68 has its thickness dimension reduced to a very small thickness so as to be reasonably flexible. Then the upper edge portion is formed in a curve 70 that extends upwardly and inwardly, and then outwardly in a somewhat downward curve, this curved portion being indicated at 74, so that this upper curved portion 74 of the chamber member side wall 68 fits snugly between the collar perimeter portion 62 of the collar 52 and the circular lip 64 of the upper container wall 32.

In addition, by initially forming the edge portion 74 of quite thin material (which then can be formed in a circular curve), stresses that might be created in thus attaching the upper edge portion 74 to the container lip 64 are not transmitted into the side wall 68 of the entry chamber housing 48.

This connection of the perimeter portion 62, circular lip 64 and the curved section 74 can conveniently be provided as follows. The inner edge of the container upper wall 32 is preformed to form the circular lip 64, and the collar 52 is also preformed with its semi-circular perimeter portion 62. The upper curved section of the entry housing 48 can either be preformed with its upper curved section 74, or this curve 74 can be made at the time of assembly.

Initially, the entry housing 48 with the tube 40 already mounted therein is positioned within the container 12 with the upper edge portion 74 of the housing sidewall 68 overlying the container lip 64. Then the mounting collar 52, with the seal and mounting member 54 and the valve stem 56 already mounted thereto is positioned in the opening at the upper end of the container 12, with the collar perimeter portion 62 overlying the curved portion 74. After this, an expanding tool is positioned within the collar 52 and is operated to push radially outwardly against the sidewall 63 of the collar 52 at approximately the location 75 to expand the collar sidewall at the location outwardly a short distance so that it forms a slanted wall section that engages part of the underside of the container lip 64. This secures the collar 52 in place. Also, this makes a tight fit between the collar perimeter portion 62, the container lip 64 and the curved portion 74 so that a proper seal is formed. This seal is formed not only with respect to the chamber 16, but also this forms a seal within the entry chamber 50.

The valve seal and mounting member 54 in terms of function has two portions, namely a lower seal portion 78, and second a mounting portion 80. The mounting portion 80 has a center opening 81 and fits within the inner circular edge of a lower wall 82 of the mounting collar 52. The mounting portion 80 has a lip or shoulder 83 that extends over the inner edge of the wall 82, and the seal portion 78 fits against the lower surface of the wall 82.

In this manner, the mounting portion 80 serves to support the valve stem 56 in the opening 81, with the valve stem supporting the valve handle portion 58 and the end nozzle section 60. The seal portion 78 forms a seal not only for the inlets of the valve stem 56, but also forms a seal with the lower collar wall 82.

To describe the valve stem 56, there is a vertical tubular portion 84 that has as its lower end a closure disk or plate 86 which in the closed position abuts against the lower circular edge 88 of the seal portion 78. The lower part of the tubular portion 84 of the stem 56 has two laterally extending openings 89. In the closed position of FIG. 1, the seal portion 78 closes these two openings 88. The upper end portion 90 of the tubular stem portion 84 has external threads so that it can be connected to the handle portion 58.

The valve handle portion 58 has a lower cylindrical mounting portion 92 which is internally threaded and fits in threaded engagement onto the upper end 90 of the valve stem tubular portion 84. This handle portion 58 has two outwardly extending actuating members or handle members 94 extending in opposite directions from one another, each of these members 94 having an upwardly concavely curved surface 96 to be engaged by the fingers of the person.

A circumferential shoulder 98 on the valve stem 56 engages the upper end of the positioning spring 59, and the lower end of the positioning spring 59 bears against the upper surface of the collar wall 82. Thus, when the handle portion 58 is depressed downwardly, the spring 59 is deformed downwardly so as to provide a restoring force to move the handle portion 58 upwardly when the handle portion 58 is released. The upper part of the handle portion 58 comprises a tubular extension 100 that is connected to the end nozzle section 60.

Figure 3:
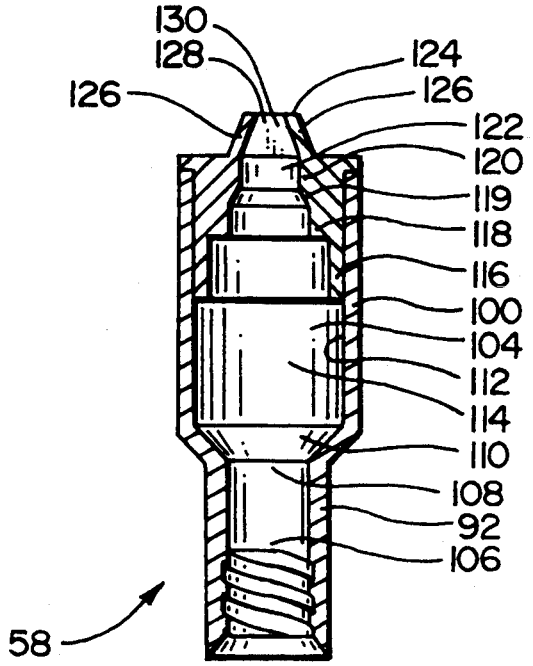
FIG. 3 is a longitudinal sectional view of that portion of the valve assembly illustrated in FIG. 2.

The tubular portion 84 of the valve stem 56 defines an upwardly extending through passageway 102 which lead into an expanded passageway section (generally designated 104) formed in the upper end portion 100 of the handle portion 58 in conjunction with the upper nozzle section 60. With reference to FIG. 3, the valve handle portion 58 is formed so that immediately above the threaded mounting portion 92, there is an initial lower passageway portion 106 which receives the very upper end of the valve stem 76, and defines an upper passage entry portion 108. This passageway portion 108 lead into an upwardly and outwardly expanding passageway portion 110 which in turn leads into an inside surface portion 112 of a greater diameter, the surface portion 112 in effect defining an expansion chamber 114 which is part of the expanded passageway portion 104. From the chamber 114, the passageway portion 104 diminishes in cross-sectional area in an upward direction, and this uppermost converging passageway section is formed by the nozzle section 60.

This nozzle section 60 is made of two molded parts which are half sections which fit within the valve handle upper portion 100 and are joined to one another along a vertical center plane as two side by side sections. There is a lowermost circular portion 116 having its diameter smaller than the diameter of the chamber surface portion 112. Immediately above the section 116 there is a further necked down section 118, and this connects to an upwardly and inwardly slanted portion 119 to a further upward portion 120 which defines a yet smaller cylindrical passageway section 122 that leads into an end nozzle portion 124.

This end nozzle section 124 comprises two plate sections or flanges 126 which define therebetween an elongate laterally extending slot 128. These two plate sections 126 converge toward one another to form the end slot 128. In addition, as can be seen in FIG. 1, at opposite ends of the two flanges 126 there are laterally and outwardly extending connecting portions 130 which have outwardly slanting upwardly facing surface portions 132. Thus, it can be seen that this passageway at 122 is transformed in an upward direction from a cylindrical passageway to a passageway which converges in one direction (caused by the plates 126 slanting toward one another), and expands in a direction 90° from the first direction (caused by the outward slant of the surfaces 132 of the connecting portions 130).

The texture material 22 within the container 12 is a mixture that comprises a carrier fluid component and a particulate material having particles which are mixed throughout the carrier fluid. The gaseous propellant 24 in the upper chamber portion 20 is at a predetermined pressure level which is above ambient pressure (e.g. 100 PSI).

The particulate material is made from an expanded polystyrene having a predetermined maximum particle size (e.g. the larger particles averaging about ⅛ of an inch across), with each particle being compressible to a smaller particle size dimension. (A compression test of a preferred form of the material indicates that under 100 PSI pressure, the volume is decreased from 100% down to 25% of the original volume). Commonly, the particles of the mixture has a variety of sizes to provide a texture surface having different particle sizes. While this polystyrene material is the preferred material, within the broader scope of the present invention other materials (desirably compressible materials) could be used.

To describe the operation of the present invention, the apparatus 10 is provided to the end user with the texture material mixture contained within the container, and with the particulate material distributed throughout the fluid component. The texture material 22 occupies at least approximately one half of the volume of the chamber 16 or possibly somewhat more than half the volume of the chamber 16. Since the apparatus 10 is commonly operated in a vertical position to apply the spray texture material upwardly to a ceiling, the texture material 22 is normally positioned in the bottom of the container 12. In use, the apparatus 10 is grasped in a person's hand, with two of the person's fingers engaging the upper surfaces 96 of the handle members 94 to depress the handle portion 58 and the valve stem 56 against the urging of the spring 59. This moves the closure disk or plate 86 downwardly to expose the openings 88. The pressurized gas 24 pushes the texture material 22 upwardly through the tube 40 into the entry chamber 50. It has been found that the particular arrangement as shown herein functions to reliably pass the particles in the mixture through the lateral valve openings 88 and into the passageway 102 defined by the valve stem 56.

The texture material 24 flows through the passageway 102 of the valve stem 56 into the expansion chamber 104, and thence upwardly through the converging passageway portion defined by the nozzle portion 60. As the texture material flows into the upper nozzle portion, the texture material expands laterally in the end nozzle portion 124 in one direction, while the passageway is diminished in the direction 90° to the first direction. The material exiting from this elongate nozzle opening 128 is disbursed upwardly and somewhat laterally to be applied to the surface (which, as indicated previously, would usually be a ceiling to which an acoustic texture material is applied.

In the preferred form, the texture mixture comprises the following ingredients:

a. A thickener that controls the film integrity of the composition;
b. a surfactant;
c. a defoamer to facilitate the processing and minimize bubbles when spraying;
d. an anti-microbial component;
e. a pigment component (often a whitener);
f. a commercially available ceiling texture material with the particles distributed therein;
g. water.

When deposited on the surface, the texture material hardens for the finished textured surface.

Figure 6:
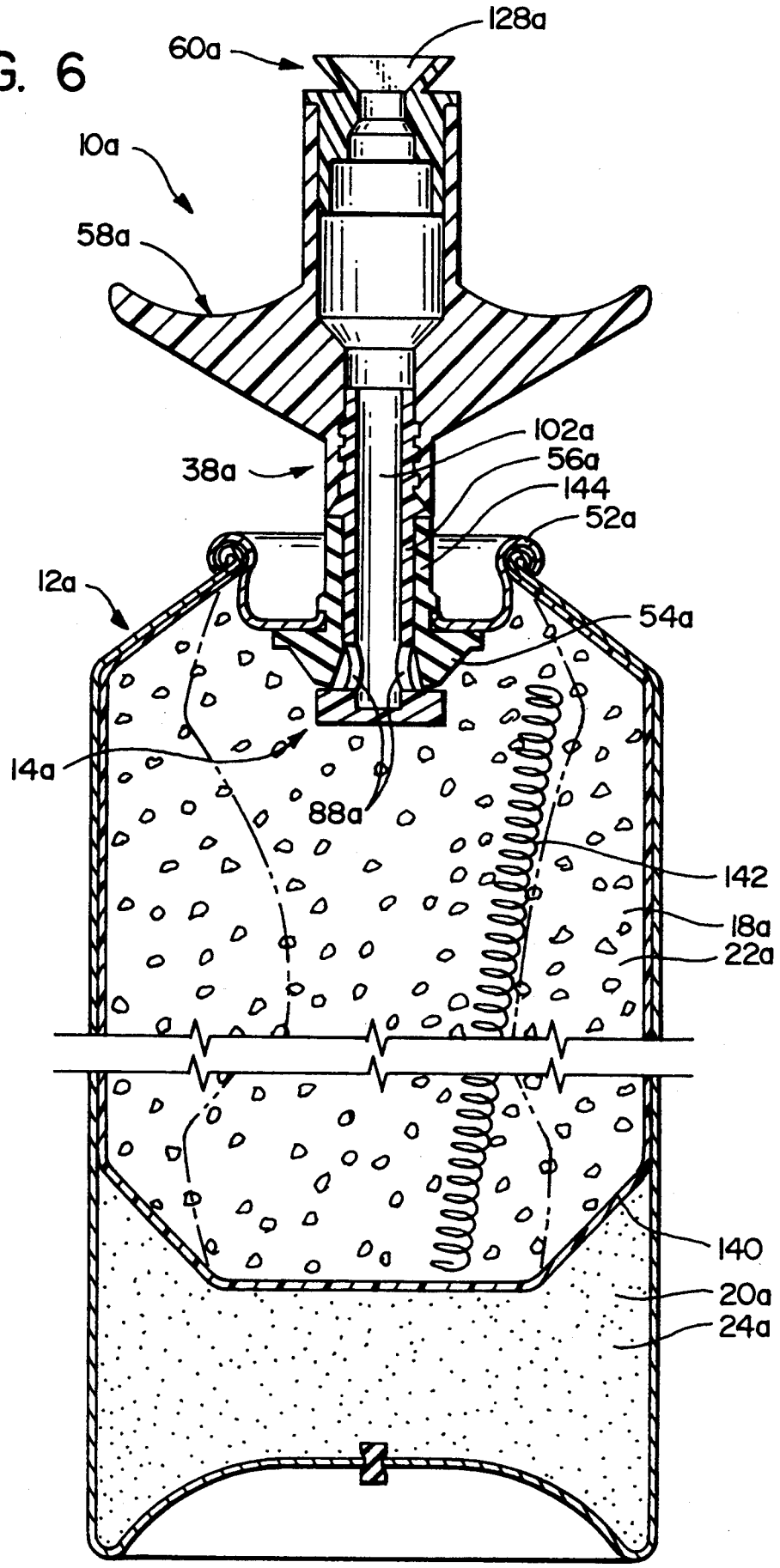
FIG. 6 is a longitudinal sectional view, similar to FIG. 1, of a second embodiment of the present invention.
Figure 7:
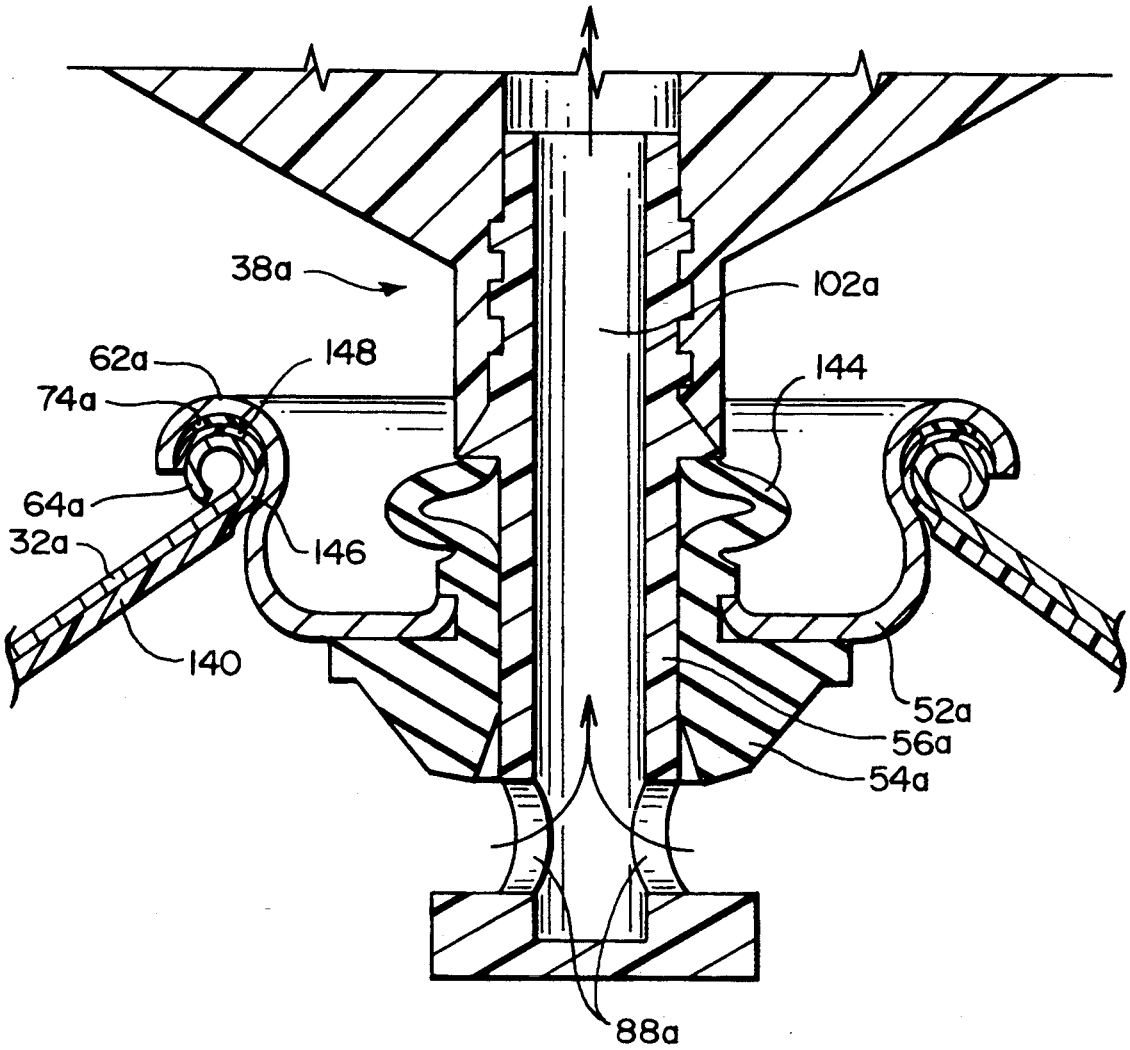
FIG. 7 is a longitudinal sectional view of the lower part of the valve assembly of the second embodiment of FIG. 6.

A second embodiment of the present invention is illustrated in FIGS. 6 and 7. Components of this second embodiment which are similar to components of the first embodiment will be given like numerical designations, with an "a" suffix distinguishing those of the second embodiment.

In this second embodiment, the apparatus **10*a* comprises a container 12*a* and a discharge assembly 14*a*. However, the discharge assembly 14*a* does not have the feed tube 40 and the entry chamber housing 48 that are present in the first embodiment 10, shown in FIGS. 1 through 5**.

Another difference in this first embodiment is that the texture material 22*a*, instead of being positioned by gravity in the bottom of the container 12*a*, is contained in a flexible sack-like container 140 that forms the texture material chamber 18*a* immediately adjacent to the valve section 38. Further, the propellant 24*a* is separated from the texture material 22*a* by the flexible container 140, and this propellant 24*a* is a vaporizable liquid which when under pressure in the container remains liquid, but with a small pressure reduction vaporizes to form a gas which pushes against the texture material 22*a*.

In order to prevent the flexible sack-like container 140 from deforming in a manner to close off the intake openings to the valve, there is provided an elongate spring 142*a* which is positioned vertically in the texture material chamber 18*a*. The upper edge of the flexible container 140 is placed in a curve over the inner rounded edge 64*a* of the container upper wall 32*a*, and beneath the curved perimeter portion 62*a* of the collar 52*a*, in the same manner as the rounded portion 74 of the entry chamber ousing of the first embodiment.

As in the first embodiment, there is the valve section 38*a* which comprises a mounting collar 52*a*, the seal and mounting member 54*a*, the valve stem 56*a*, the valve handle portion 58*a*, and the end nozzle section 60*a*. All of these components 52*a* through 60*a* are substantially the same as in the first embodiment, except that the positioning spring 59 of the first embodiment is omitted. In its place, the seal and mounting member 54 is provided with an upwardly extending resilient tube portion 144 that is made integral with the seal and mounting member 54. When the handle portion 58*a* is depressed, this deforms this resilient tubular portion 144 outwardly so as to be axially compressed.

In operation, when the valve section 38*a* is moved to the open position, the propellant 24*a* pushes the texture material 18*a* into the valve openings 88*a* and out and upwardly through the passageway 102*a*, to exit out the nozzle opening 128*a*. The manner in which this occurs is believed to be evident from the description in the first embodiment, so this will not be repeated in connection with this second embodiment.

As indicated above, as the volume of the texture material 22*a* decreases, the flexible container 140 collapses, with the propellant 24*a* expanding in the propellant chamber 20*a*.

It is apparent that various modifications could be made the present invention without departing from the basic teachings thereof.

What is claimed:

1. An aerosol dispensing apparatus to dispense against a surface a spray texture coating material comprising a carrier fluid and particulate material contained in the carrier fluid, said apparatus comprising:

a. an aerosol container defining a containing chamber having:

i. a texture material chamber portion in which said texture material is contained;

ii. a propellant chamber portion containing a propellant;

iii. said container and said chamber portions being arranged so that there is a pressure interface between said propellant and said texture material;

b. a discharge assembly having a discharge opening, an inlet opening, and valve means to control flow from said inlet opening to said discharge opening, said inlet opening being positioned to be in communication with said texture material in said texture material chamber portion, but substantially isolated from said propellant chamber portion;

c. an entry chamber housing defining an entry chamber which is positioned to receive texture material from said inlet opening, said entry chamber communicating with said valve means to transmit said texture material through said valve means when said valve means is open;

d. said apparatus having a closure sealing means comprising a perimeter edge portion of a collar means for said valve means, an inner circumferential edge portion of a top wall of the container, and an upper edge portion of said entry housing, the upper edge portion of the entry chamber housing being positioned between said perimeter edge portion of the collar means and the edge portion of the top wall of the container, whereby an effective seal is formed for said entry chamber, and also for said containing chamber.

2. The apparatus as recited in claim 1, wherein said entry chamber housing is made of a structural material which is formed as a main wall portion having a thickness dimension sufficiently great to withstand a pressure differential between said propellant in said propellant chamber portion, and the upper edge of the structural material is sufficiently thin so as to be sufficiently flexible to fit in sealing relationship between the perimeter edge portion of the collar and the edge portion of the top wall of the container.

3. The apparatus as recited in claim 2, wherein the perimeter edge portion of the collar means and the edge portion of the top wall of the container each have an upwardly convexly curved configuration, and said upper edge portion of the structural material fits in a curved configuration between the perimeter edge portion of the collar means and the edge portion of the top wall of the container.

4. The apparatus as recited in claim 2, wherein said valve means comprises a valve stem defining a flow passageway and having a lower inlet opening position in said entry chamber, and an upper end leading to the discharge opening, a seal member positioned in said entry chamber to close the inlet opening of the valve stem when the valve stem is in a closed position and to open the inlet opening of the valve stem when the valve stem is moved to an open position, said entry chamber housing being spaced sufficiently from the lower inlet opening of the valve stem to permit the particulate material to pass into said entry chamber and through the inlet opening of the valve stem.

5. The apparatus as recited in claim 4, wherein said valve stem inlet opening opens laterally into said entry chamber, said discharge assembly comprising a tube means having at a lower end thereof the inlet opening of the discharge assembly and having an upper end leading into a lower portion of said entry housing, with the lower and side wall of the entry housing being sufficiently spaced from the lower end of the valve stem and the inlet opening of the valve stem to permit flow of the particulate material of the texture material through the entry housing and into the valve stem.

6. The apparatus as recited in claim 1, wherein said valve means comprises a valve stem defining a flow passageway and having a lower inlet opening position in said entry chamber, and an upper end leading to the discharge opening, a seal member positioned in said entry chamber to close the inlet opening of the valve stem when the valve stem is in a closed position and to open the inlet opening of the valve stem when the valve stem is moved to an open position, said entry chamber housing being spaced sufficiently from the lower inlet opening of the valve stem to permit the particulate material to pass into said entry chamber and through the inlet opening of the valve stem.

7. The apparatus as recited in claim 6, wherein said valve stem inlet opening opens laterally into said entry chamber, said discharge assembly comprising a tube means having at a lower end thereof the inlet opening of the discharge assembly and having an upper end leading into a lower portion of said entry housing, with the lower and side wall of the entry housing being sufficiently spaced from the lower end of the valve stem and the inlet opening of the valve stem to permit flow of the particulate material of the texture material through the entry housing and into the valve stem.

8. An aerosol dispensing apparatus to dispense against a surface a spray texture coating material, said apparatus comprising a. an aerosol container defining a containing chamber and having an upper dispensing end and a lower end;

b. said spray texture material being located in said chamber and comprising a carrier fluid with particulate material distributed throughout said carrier fluid;

c. a pressurized gaseous propellant which is inert, relative to the particulate material, being located in said chamber;

d. said container and said chamber being arranged so that with the container upright, the spray texture material is in the lower part of said chamber, said gaseous propellant is in an upper part of said chamber, and there is a pressure interface between said propellant and said texture material;

e. a discharge assembly comprising an infeed section having tube means with an inlet opening positioned at a lower end of said chamber to receive the texture material flowing into said tube means, and a manually operable valve section having a discharge nozzle, said valve section being operatively connected to said infeed section to control flow of the texture material from said inlet opening to said discharge nozzle;

whereby with said container upright, said spray texture material can be expelled from said container through said nozzle discharge by expansion of side pressurized gas acting against said spray texture material in said container.

9. The apparatus as recited in claim 8, wherein said particulate material comprises particles which are compressible.

10. The apparatus as recited in claim 9, wherein said particulate material is expanded polystyrene.

11. The apparatus as recited in claim 10, wherein said pressurized gas is selected from a group made up of atmospheric air, nitrogen, and a combination thereof.

12. The apparatus as recited in claim 9, wherein said pressurized gas is selected from a group made up of atmospheric air, nitrogen, and a combination thereof.

13. The apparatus as recited in claim 9, wherein said valve section defines a valve passageway having a first passageway portion of smaller diameter, and a second passageway portion having a greater diameter and leading from said first passageway portion to said nozzle.

14. The apparatus as recited in claim 13, wherein said nozzle comprises a pair of side plates which define an elongate slot to receive flow from said second passageway portion.

15. The apparatus as recited in claim 14, wherein said slot defined by said two side plates has in one direction a width dimension which diminishes in a converging configuration upwardly and a lengthwise dimension at right angles to said width dimension have a diverging configuration in an upward direction to discharge said spray texture material in a fan configuration.

16. The apparatus as recited in claim 8, further comprising an entry chamber housing defining an entry chamber which is positioned to receive the texture material from the tube means and direct said texture material to said valve section, said apparatus having a closure sealing means comprising a perimeter edge portion of a collar means for said valve section, an inner circumferential edge portion of a top wall of the container, and an upper edge portion of said entry housing, the upper edge portion of the entry chamber housing being positioned between said perimeter edge portion of the collar means and the edge portion of the top wall of the container.

17. The apparatus as recited in claim 16, wherein said entry chamber housing is made of a structural material which is formed as a main wall portion having a thickness dimension sufficiently great to withstand a pressure differential between said propellant in said propellant chamber portion, and the upper edge of the structural material is sufficiently thin so as to be sufficiently flexible to fit in sealing relationship between the perimeter edge portion of the collar and the edge portion of the top wall of the container.

18. The apparatus as recited in claim 8, wherein said carrier fluid comprises a thickener to control film integrity, a surfactant, a defoamer, an anti-microbial component, a pigment component, and a hardenable material.

19. A method of providing and dispensing a spray texture coating material against a surface, said method comprising a. providing an aerosol container defining a containing chamber and having an upper dispensing end and a lower end, and containing a spray texture material comprising a carrier fluid with particulate material distributed throughout said carrier fluid;

b. providing in said chamber a pressurized gaseous propellant which is inert, relative to the particulate material being located in said chamber, in a manner that with the container upright, the spray texture material is in the lower part of said chamber, said gaseous propellant is in an upper part of said chamber, and there is a pressure interface between said propellant and said texture material;

c. providing a discharge assembly comprising an infeed section having tube means with an inlet opening positioned at a lower end of said chamber to receive the texture material flowing into said tube means, and a manually operable valve section having a discharge nozzle and a valve, said valve section being operatively connected to said infeed section, and operating said valve to cause flow of the texture material from said inlet opening and through said discharge nozzle by expansion of side pressurized gas acting against said spray texture material in said container.

20. The method as recited in claim 19, wherein said particulate material comprises particles which are compressible.

* * * * *